US009987877B1

(12) United States Patent
Dunn et al.

(10) Patent No.: US 9,987,877 B1
(45) Date of Patent: Jun. 5, 2018

(54) VISUAL INDEXING TOOL AND METHODS

(71) Applicants: Nathan T. Dunn, Downey, CA (US); Mindy L. Dunn, Downey, CA (US)

(72) Inventors: Nathan T. Dunn, Downey, CA (US); Mindy L. Dunn, Downey, CA (US)

( * ) Notice: Subject to any disclaimer, the term of this patent is extended or adjusted under 35 U.S.C. 154(b) by 62 days.

(21) Appl. No.: 13/789,406

(22) Filed: Mar. 7, 2013

Related U.S. Application Data

(60) Provisional application No. 61/608,843, filed on Mar. 9, 2012.

(51) Int. Cl.
*B42F 21/00* (2006.01)
*B42D 15/00* (2006.01)

(52) U.S. Cl.
CPC ..... *B42F 21/00* (2013.01)

(58) Field of Classification Search
CPC ..... B42F 21/00; B42D 15/00
USPC ... 283/36, 37, 38, 39, 40, 41, 42, 43, 67, 70
See application file for complete search history.

(56) References Cited

U.S. PATENT DOCUMENTS 6,099,189 A * 8/2000 Owen ..... B42F 21/00 281/38
6,736,428 B1 * 5/2004 Insalaco ..... B42F 21/00 281/38
2012/0146322 A1 * 6/2012 Erisalu ..... B42D 15/00 283/81

* cited by examiner

*Primary Examiner* — Justin V Lewis
(74) *Attorney, Agent, or Firm* — Donald E. Stout; Stout, Uxa & Buyan, LLP

(57) ABSTRACT

The present invention provides a system and method for effectively indexing and using an extensive reference book, such as the Bible, by topic, so that appropriate information related to a desired topic may be conveniently and quickly accessed in a timely and useful way.

19 Claims, 5 Drawing Sheets

VISUAL INDEXING TOOL AND METHODS

This application claims the benefit under 35 U.S.C. 119(e) of the filing date of Provisional U.S. Application Ser. No. 61/608,843, entitled Visual Indexing Tool and Methods, filed on Mar. 9, 2012, and expressly incorporated herein by reference, in its entirety.

BACKGROUND OF THE INVENTION

A number of reference books are written to convey useful information concerning a variety of situations that may arise in daily living. However, when those situations arise, there is often inadequate opportunity to thumb through the book to find the desired information in a timely way.

Reference books of the type noted above which provide this sort of guidance are often spiritual texts, of which the Christian Bible is one very prominent example. The Bible is arranged into two major sections, the Old Testament and New Testament, and is further subdivided into a total of 66 books, each of which comprises one or more chapters, with a number of verses in each chapter. A great variety of topics are addressed in the Bible, but the text is narrative in nature, and the information on each topic is typically dispersed throughout what is a significant volume of material.

Accordingly, it would be helpful, in the case of the Bible and other reference books of that general nature, if the information contained in the book could be indexed in a visual and effective way so that guidance related to specific situations could be quickly accessed and used while those situations are immediately applicable.

SUMMARY OF THE INVENTION

The present invention provides a system and method for effectively indexing and using an extensive reference book, such as the Bible, by topic, so that appropriate information related to a desired topic may be conveniently and quickly accessed in a timely and useful way.

More particularly, the inventive method provides an approach for indexing a reference book, which comprises steps of consulting a key card having a top edge, opposed left and right side edges, and a bottom edge, wherein a plurality of blocks are disposed along at least one of the top edge, the right side edge, and the bottom edge. Each block contains a printed topic to be indexed in the reference book, wherein the topics disposed in each of the blocks along a key card edge are arranged sequentially, and each block on the same key card edge is printed in a distinctive color different from the colors of the other blocks along that key card edge. A further method step includes consulting a tabbing guide having a top edge, opposed left and right side edges, and a bottom edge, wherein the tabbing guide comprises a plurality of blocks disposed along one of the top, right side, and bottom edges thereof, so that the plurality of blocks correspond positionally to the plurality of blocks disposed along the corresponding edge of the key card, wherein the plurality of blocks on the tabbing guide each contain the same topics as those in positionally corresponding blocks on the key card. Positionally corresponding blocks on each of the tabbing guide and the key card are also printed in substantially identical colors. The tabbing guide further comprises at least one cell corresponding horizontally or vertically to each of the plurality of blocks, each cell containing reference information related to the topic corresponding to that cell.

A further step involves locating the referenced information in one of the cells on the tabbing guide, corresponding to a particular related topic, on a particular page of the reference book being indexed. The referenced information is then highlighted on the particular book page, using a color substantially corresponding to the color of the block of the corresponding related topic on each of the key card and the tabbing guide. Then, a flag or tab, having a color substantially corresponding to the color of the block of the corresponding related topic on each of the key card and the tabbing guide, is placed on an edge of the particular book page which corresponds to the edge of the key card and tabbing guide on which the block containing the relevant topic is disposed.

Preferably, the key card consulting step further comprises permanently placing, such as by adhering, the key card inside a front cover of the reference book. In order to continue the indexing process, the tabbing guide consulting step, the locating step, the highlighting step, and the placing step are each repeated a second time to highlight a second passage of referenced information and to place a second flag or tab to denote the second passage of referenced information. The second passage of referenced information may be highlighted in the same color as the previous passage of referenced information, in which case the second flag or tab is also of the same color as the previous flag or tab, because the two referenced information passages are related to the same topic. Alternatively, the second passage of referenced information may be highlighted in a different color than the previous passage of referenced information, in which case the second flag or tab is of a different color than the previous flag or tab because the two referenced information passages are related to different topics.

In order to complete the indexing process, the tabbing guide consulting step, the locating step, the highlighting step, and the placing step are each repeated until all of the referenced information in each cell on the tabbing guide has been highlighted and flagged.

The key card, in preferred methods of the invention, comprises a plurality of the aforementioned printed blocks disposed along each of the top, right-side, and bottom edges of the key card. In this instance, the tabbing guide includes blocks along one of the top, right-side, and bottom edges which correspond in topic and color to the blocks on the same one of the top, right-side, and bottom edges of the key card. Second and third tabbing guides include blocks, respectively, on each of the other two edges of each guide, corresponding in topic and color to the blocks on the corresponding edges, respectively, on the key card. In this case, the indexing process is completed by repeating the tabbing guide consulting step, the locating step, the highlighting step, and the placing step until all of the referenced information in each cell on each of the tabbing guides has been highlighted and flagged, and flags or tabs are disposed on each of top, right-side, and bottom edges of various pages of the book.

In the disclosed exemplary method, the book comprises a Bible and the referenced information in each cell of the tabbing guide comprises a Bible verse or passage. Moreover, the topics disposed in the blocks on each of the key card and the tabbing guide are related to child behavior, and are sequenced along a particular edge of each of the key card and the tabbing guide in alphabetical order. However, the inventive method is sufficiently broad to encompass many different types of reference books, where information to be indexed is systematically presented.

The placing step may further include a step of placing the tabbing guide on the page of the book containing the highlighted referenced info' cation, and placing the tab or flag at a location on the top, right-side, or bottom edge of the book page which positionally corresponds with the location on the same edge of the tabbing guide of the block containing the topic relevant to the highlighted referenced information. This placement correspondence facilitates the later use of the indexed book, by allowing a user to quickly locate desired referenced information. The preferred method further comprises a step of storing the tabbing guides in the book for future reference.

The method as disclosed further comprises a step of using the indexed book by consulting the key card, selecting a topic to be reviewed, noting the color of the block in which the topic appears on the key card, identifying one or more flags or tabs of the same color, and reviewing highlighted passages of the same color on pages of the book marked by the flags or tabs.

In some instances, rather than providing a kit including pre-printed key cards and tabbing guides, blank versions may be provided. In this situation, the inventive method may further comprise a step of preparing the key card by marking desired topics in printed blocks disposed on the key card, and a further step of preparing one or more corresponding tabbing guides, by repeating the topics disposed on the key card, and inserting reference material to be indexed in appropriate cells corresponding to each of the topics. The key card and tabbing guide preparing steps may be performed using software and a printer, or manually, as desired.

In another aspect of the invention, there is provided a kit for indexing a reference book, which comprises a key card having a top edge, opposed left and right side edges, and a bottom edge, wherein a plurality of printed blocks are disposed along at least one of the top edge, the right side edge, and the bottom edge, wherein each block along a particular edge of the key card is printed in a distinctive color relative to the remaining blocks. The kit further comprises a tabbing guide having a top edge, opposed left and right side edges, and a bottom edge, wherein the tabbing guide comprises a plurality of blocks disposed along one of the top, right side, and bottom edges thereof, so that the plurality of blocks correspond positionally to the plurality of blocks disposed along the corresponding edge of the key card. Each of the blocks on the tabbing guide are printed in the same distinctive color as a corresponding block on the corresponding edge of the key card. The tabbing guide further comprises at least one printed cell corresponding horizontally or vertically to each of the plurality of blocks.

The key card, in preferred embodiments, includes a plurality of printed blocks on each of the top edge, the right side edge, and the bottom edge thereof. In this instance, the kit further comprises second and third tabbing guides, which each have a plurality of printed blocks disposed, respectively, along each of the remaining ones of the top, right side, and bottom edges of the tabbing guides. The printed blocks on each of the three tabbing guides correspond positionally and by color to the printed blocks on one of the top, right side, and bottom edges of the key card.

The printed blocks on each of the key card and the tabbing guide may be provided in a blank state, so that the purchaser can customize the cards with desired topics, or they may be pre-printed with predetermined topics.

While the foregoing describes the inventive methods and products in connection with paper books and paper key cards and tabbing guides, the principles of the invention are clearly also applicable to electronic books, in which case the key card, tabbing guides, highlighting, and tabs and flags are also in an electronic format.

The invention, together with additional features and advantages thereof, may best be understood by reference to the following description taken in conjunction with the accompanying illustrative drawings.

DESCRIPTION OF THE DISCLOSED EMBODIMENTS

Figure 1:
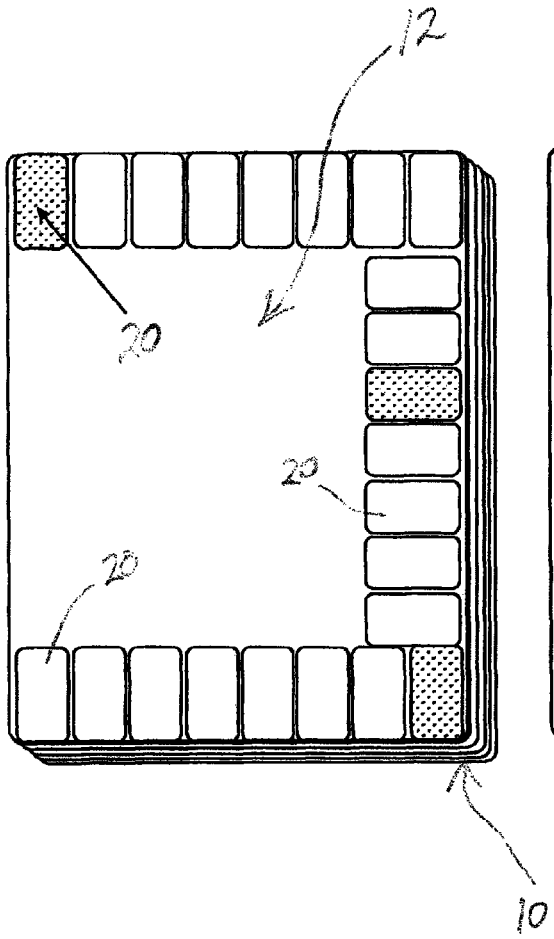
FIG. 1 is a schematic view of a key card of the inventive system.

Referring now to the accompanying figures of the drawing, an inventive three part method for indexing a book 10 using a key card 12 (FIG. 1), tabs or flags 14 (FIG. 2), and a color/symbol coded correlating identification marker 16 in the text 18 of the book 10 (FIG. 3) is described. The key card 12 is inserted into the book 10 at any point, such as the front cover, inside any of the pages, or on the back cover. The key card 12 includes a plurality of blocks 20 (FIG. 1) on each of the top, right side, and bottom edges, as shown, which form the basis of the inventive indexing system. In one example, wherein the system is adapted for indexing a Bible for child training purposes, to be described more fully in an example below, the blocks each contain a single behavioral topic which may be addressed using the system. For example, on the top edge of the key card, topics are listed alphabetically from left to right, disposed in each of the blocks 20. Specifically, in one example, these topics comprise "Anger", "Complaining", "Defiance", "Discouraged", "Disobedience", "Fear", and "Fighting". Then, from top to bottom on the side edge of the card 12, the topics in each block 20 are "Gospel", "Impatience", "Jealousy", "Laziness", "Lying", "Making Excuses", and "Not Listening". Finally, on the bottom edge of the card 12, from right to left alphabetically, the blocks 12 contain "Pride", "Quarreling", "Selfishness", "Stealing", "Tattling", "Unforgiveness", and "Wrong Friendships". It should be noted that these topics, and this example, are only illustrative. The biblical topics may vary (i.e. different behaviors, issues related to marriage, etc.), or the system may be used with a different type of reference book entirely. The key card 12 is preferably made of heavy card stock and is laminated for durability.

Figure 2:
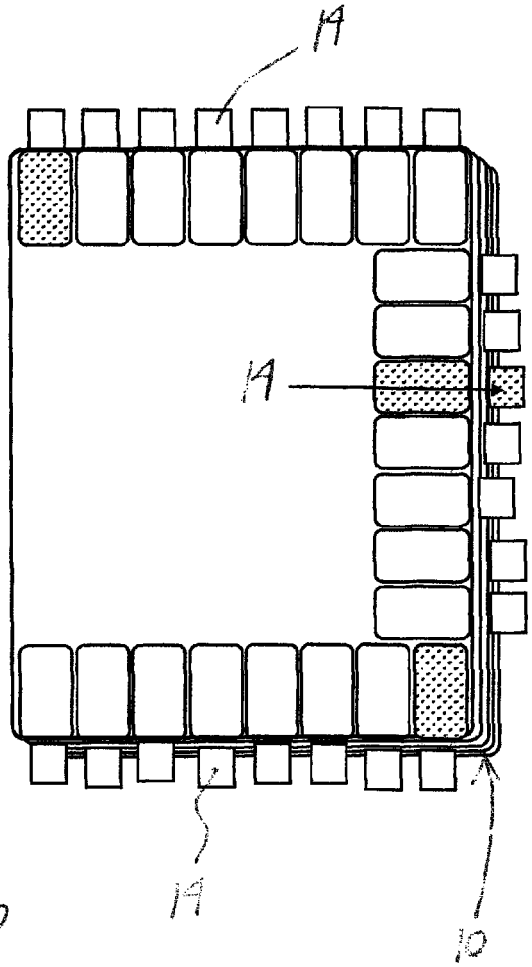
FIG. 2 is a view of the key card of FIG. 1 installed in a book with corresponding color-coded tabs or markers in place, in accordance with the inventive system.
Figure 3:
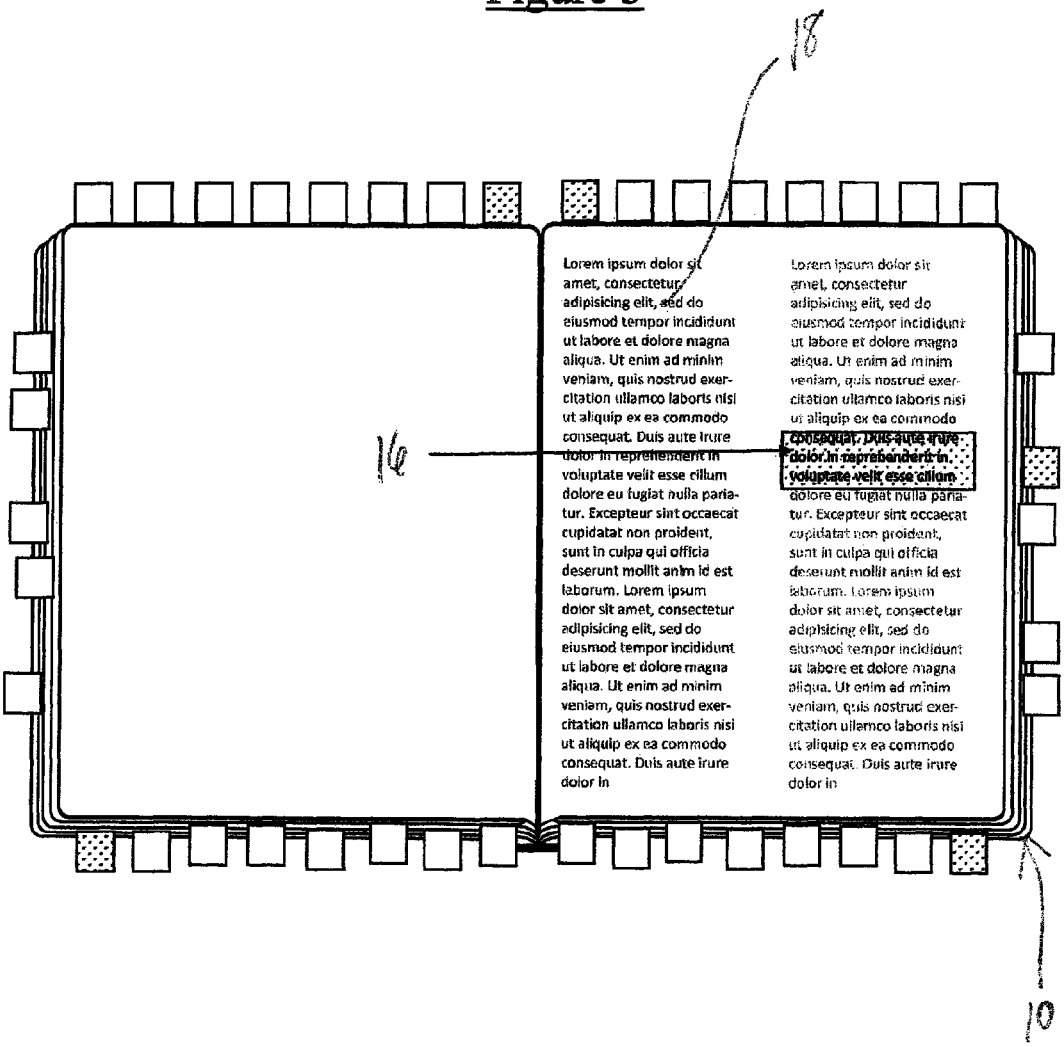
FIG. 3 is view of a page of a book wherein the inventive system and method have been incorporated, illustrating a portion of text highlighted in accordance with the system.
Figure 4:
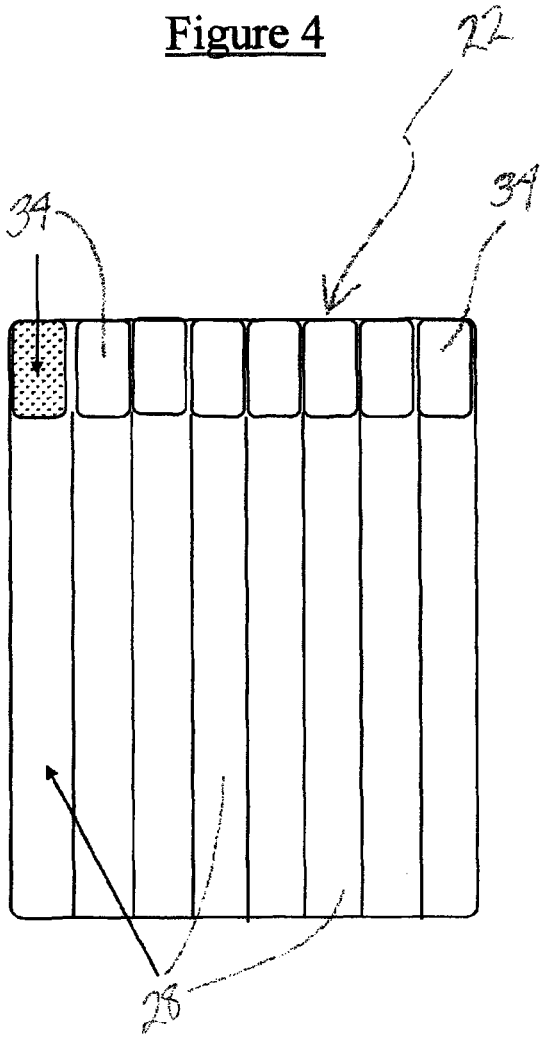
FIG. 4 is a view of the front side of a top row tabbing guide in accordance with the inventive system.
Figure 5:
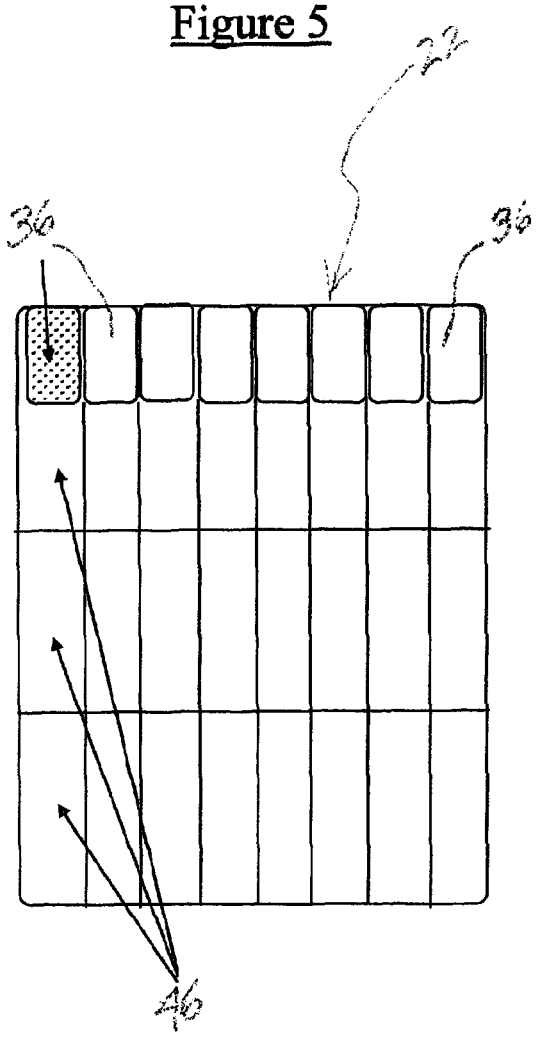
FIG. 5 is a view of the back side of the top row tabbing guide of FIG. 4.
Figure 6:
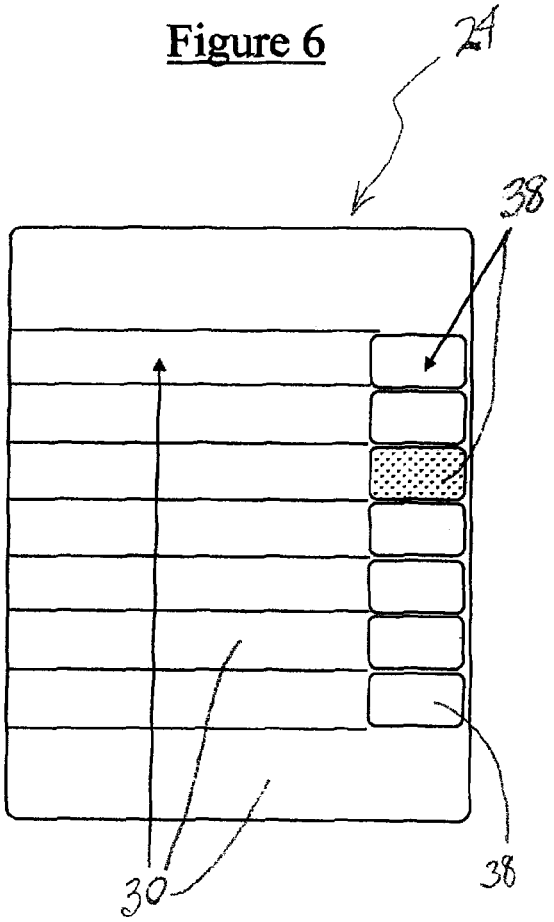
FIG. 6 is a view of the front side of a side row tabbing guide in accordance with the inventive system.
Figure 7:
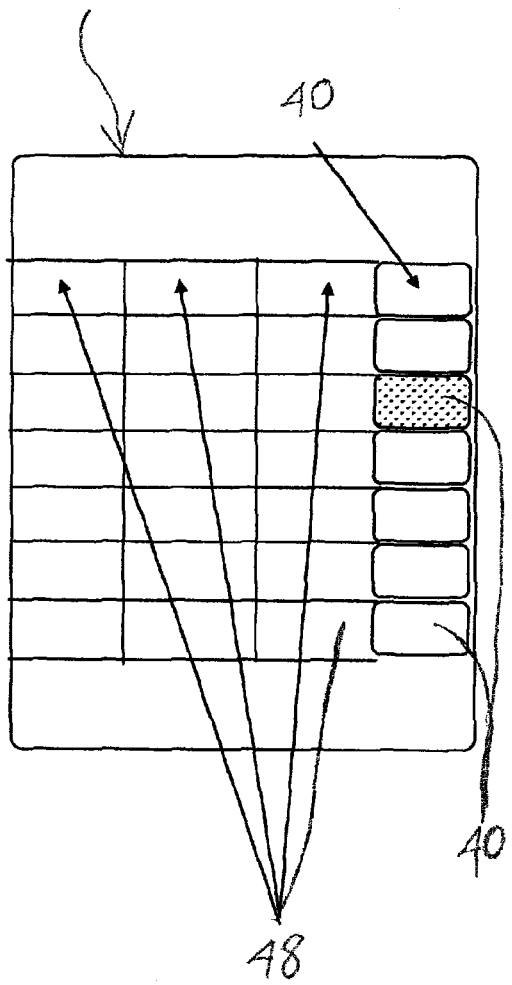
FIG. 7 is a view of the back side of the side row tabbing guide of FIG. 6.
Figure 8:
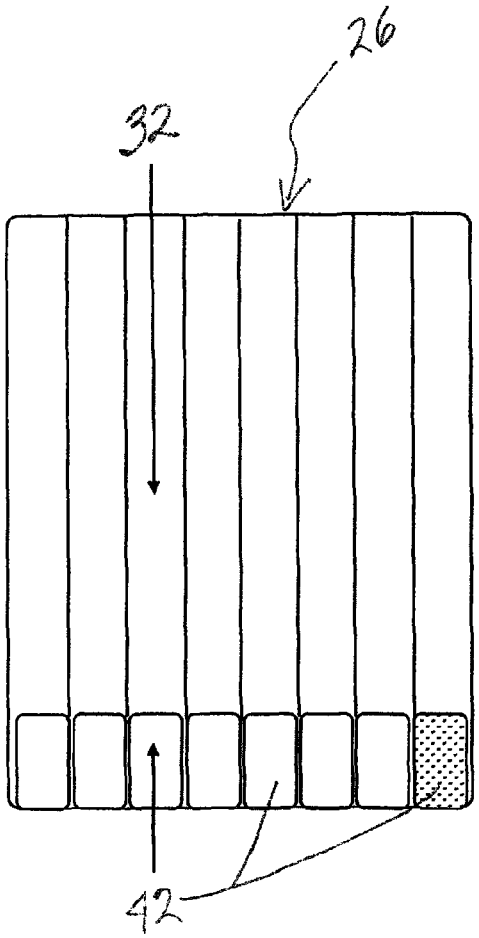
FIG. 8 is a view of the front side of a bottom row tabbing guide in accordance with the inventive system.
Figure 9:
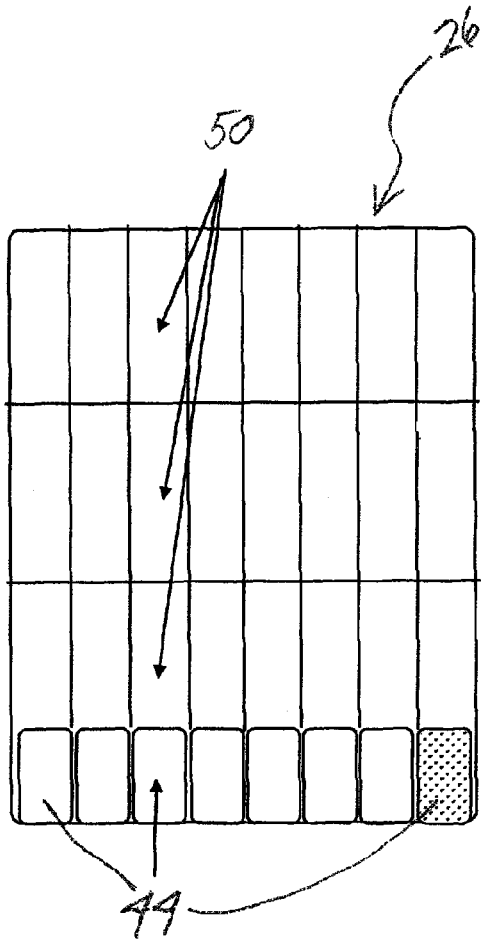
FIG. 9 is a view of the back side of the bottom row tabbing guide of FIG. 8.

Once the key card 12 is affixed to any of these pages, then placing the tabs/flags 14 (FIG. 2) can begin. The process of placing the tabs 14 is guided by tabbing guides 22, 24, and 26 (FIGS. 4-9). In the illustrated embodiment, there are three guides, printed on both sides, which correlate to the three unbound sides of the book (top, right side, and bottom). Thus, these guides include a top row guide 22 (FIGS. 4 and 5 illustrate the front and back sides, respectively), a side row guide 24 (FIGS. 6 and 7 illustrate the front and back sides, respectively) and a bottom row guide 26 (FIGS. 8 and 9 illustrate the front and back sides, respectively). These guides contain information for the user to find an appropriate section of the book, for example in reference cell 28 (FIG. 4), reference cell 30 (FIG. 6), and/or reference cell 32 (FIG. 8). The tabbing guides 22, 24, 26 are also preferably made of heavy card stock, like the key card 12, and are also laminated. The reference cell 28 may, in the illustrated example, contain a Bible verse or passage, or other suitable information related to the corresponding topic. These guides 22, 24, 26 can be preprinted with cross-referenced information, or be blank for the end user to fill out information as they tab through a book. The guides are color/symbol correlated to the key 12 (FIG. 1), as well as the tabs 14 (FIG. 2) and identifying markers 16 (FIG. 3).

In the illustrated example, wherein the tabbing guides 22, 24, 26 are pre-printed, a method for using them is described below:

Method for Using Pre-Printed Tabbing Guides

In the exemplary illustrated embodiment, pre-printed tabbing guides 22, 24, 26 include topics in blocks 34 on the front side of guide 22 (FIG. 4), 36 on the back side of guide 22 (FIG. 5), 38 on the front side of guide 24 (FIG. 6), 40 on the back side of guide 24 (FIG. 7), 42 on the front side of guide 26 (FIG. 8), and 44 on the back side of guide 26 (FIG. 9). These topics correspond to the topics found on the key card 12, noted above. For example, in the illustrated and described example, the blocks 34 and 36 contain the same topics, arranged left-to-right, as are found on the top edge of the key card 12, in blocks 20. In the example discussed above, the top-edge topics are, sequentially, "Anger", "Complaining", "Defiance", "Discouraged", "Disobedience", "Fear", and "Fighting". For that same exemplary situation, the topics in both blocks 34 and 36 correspond. Similarly, the side-edge topics found in blocks 20 of FIG. 1 are disposed in the blocks 38 and 40 in FIGS. 6 and 7. The bottom-edge topics found in the blocks 20 of FIG. 1 are disposed in the blocks 42 and 44 in FIGS. 8 and 9.

In addition to the aforementioned reference cells 28, 30, and 32 on the front side of each tabbing guide 22, 24, 26, respectively, there is additional reference information found in reference cells 46 (FIG. 5), reference cells 48 (FIG. 7), and reference cells 50 (FIG. 9) on the respective back sides of each tabbing guide 22, 24, 26. Using the information found in a particular reference cell on the front side of each guide 22, 24, 26, such as a reference cell 28 in FIG. 4, which in the described and illustrated example will typically be a Scripture verse or passage (multiple verses), the user may find the referenced information (e.g. the Scripture verse or passage) in the book (Bible) 10 and then proceed to color/highlight/notate the appropriate portion 16 of text (FIG. 3). Once this text 16 is highlighted as desired, the user may use the guide 22 to place the tab/flag 14 in the appropriate location along the top edge of the book. This procedure is followed until the top row of tab/flags 14 is placed. The same procedure is then followed in placing tabs/flags 14 along the side of the book, using the side row tabbing guide 24. The bottom of the book 10 also follows, in the same manner, the placement of tabs/flags 14 along the bottom of the book, using the bottom row tabbing guide 26. If there is any additional information that is to be conveyed along with the information (e.g. Scripture verse or passage) in the reference cells on the front side of each tabbing guide, this additional information may be found on the back side of each tabbing guide 22, 24, 26, in any number of cells 46, 48, 50, respectively, that correspond to the previously tabbed section (36 of FIG. 5), (40 of FIG. 7), (44 of FIG. 9). In one example, this additional information, keyed to the same top, side, or bottom edge topics, respectively, may include questions or prayers related to the topic and/or further reference information appropriate to the topical issue. Of course, the information can be reversed, with the Scripture verses set out in the cells 46, 48, 50, respectively, on the back sides of each tabbing guide 22, 24, 26, and the additional, related information in the cells 28, 30, 32, respectively, on the front sides of each tabbing guide. The specific nature of the information disposed in the tabbing guide cells is not critical to the inventive method, but rather the point that at least some of the provided information, keyed either vertically or horizontally to a corresponding topic, is found in a specific area of the corresponding reference book and can be highlighted and tabbed therein.

Once the indexing process noted above is completed, the indexed information may be readily accessed at any time using the key card 12 of FIG. 1. The appropriate top, side, or bottom block 20 is consulted, at which point the corresponding colored flags or tabs 14 are readily found. Each page of the book on which each corresponding tab 14 is placed may then be opened to find the pertinent piece of information (identifying marker 16), which may, for example, comprise a Bible verse that has been highlighted in a color matching the corresponding tabs 14, key 20, and corresponding highlighted text markers 16.

Method for Using Blank Tabbing Guides

For tabbing guides that contain no printed information other than color or symbols on the key, an inventive method is as follows. The user finds a passage and chooses a color or symbol to indicate at 16 where the passage is located in the text (FIG. 3). Then the user employs a blank guide 22, 24, 26 to place a tab/flag 14 of correlating color/symbol to indicate where in the text the passage is found. At this point the user may want to delineate a category for their indexing and this can be placed on the key card 12 (FIG. 1) in a block 20 and on the guide at 34 (FIG. 4) or 36 (FIG. 5), for example. Extra notes or references can be placed in the columns or rows of the guide to aid the user in his/her study of the text. This process can be followed for all sides and all categories that the user wishes to index.

Once the foregoing creating process is completed, the indexing system may be used in a manner similar to that described above in connection with the pre-printed guides.

While the foregoing description relates to manual approaches for preparing and using the inventive visual indexing system, the system may also be automated by using appropriate software, wherein the software may be used to develop a key and selections for tabbing cards. A database is provided having a variety of topics suited for one or more particular reference books. This software and database provides the reference location of the topic and the software then is used to generate a user-specified key with pre-printed topic selection. It is also used to generate tabbing cards that easily allow the user to flag or tab the location of different relevant references. The software is able to generate keys in any color, and to design them to spatially fit on any book with any number of sides. A user is also able to use the software to add additional topics of his/her own choosing, with appropriate references in one or more appropriate reference books.

Following is a particular example of an application of the invention, for a case where pre-printed tabbing guides 22, 24, 26 are provided. In this example, it is desired to create a visual index for a Bible, for the purpose of indexing information related to specific principles of child training:

Example—Child Training Bible™ Instructions

1. Supplies a Hardcover ESV Pew Bible 10 (Any 6×9 in. Bible will work, and kits may be adapted for any sized Bible or other reference book)

b. 7 Colors of highlighters or colored pencils (number of colors may vary)

c. 7 Matching Colors of Post-It Flags 14 (again, number of colors may vary, but should correspond to the colors of the available highlighters or colored pencils).

d. Cut and laminated Child Training Bible (CTB) key card 12 e. Cut Double-Sided Tabbing Guides 22, 24, 26 f. Pencil g. Double-sided tape

In this particular case, a kit is provided which includes the cut and laminated CTB key card 12 (FIG. 1), three Cut Double-Sided premade Tabbing Guides 22, 24, 26, and an instruction sheet containing the information herein disclosed. The remaining items on the above list (Bible, tabs or flags 14, highlighters/colored pencils, pencil, double-sided tape) are preferably purchased separately by the customer. Of course, alternatively, one or more of the additional remaining items may also be provided in the kit. The purpose of this method is to prepare the Bible 10 for quick reference to a number of Bible verses related to child discipline, in a number of different behavior categories.

2. The CTB Key Card 12 (FIG. 1)

Using double-sided tape, the laminated key card 12 is placed on the first page of the Bible 10. It is preferably taped to the first page on the right side of the Bible 10. It is preferably fabricated from a thicker, cardstock material, relative to the pages of the Bible, as noted above, and laminated as well. The key card 12 allows the user to select a particular behavior and color to be referenced when the CTB is being used as part of a child's disciplinary process.

3. Ready to Tab a. The first CTB Tabbing Guide 22 is shown in FIGS. 4 and 5, which show the front and back sides of the guide 22, respectively. As noted above, it is preferably fabricated from the same cardstock material as the key card 12, as are the other tabbing guides 24, 26, and is printed on both sides. Though not illustrated, the card says "Anger" at the top, in the upper left-most block 34. Anger is one of the behaviors addressed by this system. Two sets of questions, identified as "Get at the Heart Questions" and "Glory in the Gospel Questions", as well as a Scripture Prayer are on one side of the guide 22 (FIG. 4—reference cells 28) and a list of Scripture References is on the other side (FIG. 5—reference cells 46). Alternatively, the noted questions and prayer, as well as the scripture references, may be printed on the opposed sides, in the opposed cells.

b. All of the Scripture references on the appropriate side of the guide 22 are in biblical order from top to bottom. This makes the process of locating scriptures from the Old Testament to the New Testament, in book order, much easier.

c. As an example, a user may first find the first Scripture for the behavior topic "Anger", by locating the block 34 containing the topic word "Anger", and then moving downwardly through the columnar cell 28 beneath that block 34. This topic block is colored yellow. Therefore, each referenced verse under this topic heading is located and highlighted in the Bible using the corresponding yellow highlighter or colored pencil, and a corresponding yellow tab 14 is placed on the top left side of the right page of the Bible.

d. It should be noted that the post-it tab 14 is always placed on the right-hand page, even if the highlighted scripture is on the left-hand page. This convention is helpful as multiple tabs 14 are placed per page and one wants to quickly see what is tabbed on a certain page.

e. Each time a tab is placed on a particular page, the Tabbing Guide 22 is placed on the right page to quickly identify the location where the tab 14 should go, in direct correspondence to the left-to-right location of the corresponding topic block 34. This helps the user to evenly and neatly space all of their colored tabs.

f. As each verse is tabbed, a check mark is placed next to the reference on the tabbing guide 22 to help the user keep their place.

g. The entire top side of the key card 12 is completed first. In one illustrated example, the behaviors Anger through Fighting, alphabetically, extend across the top of the card, as noted above. Then, the side Tabbing Guide 24 (FIGS. 6 and 7), followed by the bottom Tabbing Guide 26 (FIGS. 8 and 9) are processed in the same way.

4. Tabbing Tip

Once the side and bottom sections 24, 26 of the CTB are processed, the user will begin to encounter pages in the Bible that will have two or more verses highlighted in the same color. To avoid confusion, a pencil may be used to write the specific sinful behavior next to each verse that is highlighted in the same color.

5. Process for Using the CTB in Child Discipline a. The child is taught about the CTB i. The parent or guardian explains that he/she will be using a specially tabbed Bible to talk with them about what God says about certain behaviors.

ii. The parent or guardian explains that they have spent a long time making this Bible with special stickers that are not to be played with.

iii. During a Bible Moment it is explained to the child that he/she will need to keep his/her hands folded and not touch the special tabs.

b. The order of the Bible Moment i. The calm child is invited to meet with the parent or guardian for a Bible Moment together.

ii. The key card 12 is consulted for the purpose of finding the particular behavior to be addressed.

iii. Depending on the age and attention span of the child, all or perhaps a few of the appropriate tabs are selected for review.

iv. The highlighted Scripture is read and discussed.

v. The questions in the cells on the back side of the appropriate Tabbing Guide are consulted to get to the heart of the child, and may be discussed with the child, at the parent's discretion.

vi. The Bible Moment is concluded by praying using scripture. A sample prayer is provided in the appropriate cells on the back side of the tabbing guides, as noted above.

vii. The three Tabbing Guides/Question Cards may be stored in the back of the CTB using a bulldog clip.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention. For example, although the invention is described in connection with paper books, paper key cards, and paper tabbing guides, it is equally applicable to digital media, wherein a digital book is indexed using a digital key card and digital tabbing guides. In such an instance, both the highlighting and the tabbing/flagging would be performed digitally rather than by the use of ink highlighters or adhesive tabs/flags.

What is claimed is:

1. A method for indexing a bound reference book comprising a plurality of pages which are pre-printed with reference information, the method comprising:

inserting a key card into the bound reference book at a particular location, the key card having a top edge, opposed left and right side edges, and a bottom edge, wherein a plurality of printed blocks, each comprising a plurality of printed lines defining an interior space, are disposed along at least one of the top edge, the right side edge, and the bottom edge, each block containing in its interior space a printed topic to be indexed relative to the pre-printed reference information on the plurality of pages in the bound reference book, wherein the topics disposed in each of the blocks along a key card edge are arranged sequentially, and each block is printed in a single distinctive color different from the colors of the other blocks along that key card edge;

affixing the key card in place at the particular location in the bound reference book;

consulting a tabbing guide having a top edge, opposed left and right side edges, and a bottom edge, wherein the tabbing guide comprises a plurality of blocks disposed along one of the top, right side, and bottom edges thereof, so that the plurality of blocks correspond positionally to the plurality of blocks disposed along a corresponding edge of the key card, wherein the plurality of blocks on the tabbing guide each contain corresponding topics to those in positionally corresponding blocks on the key card, positionally corresponding blocks on each of the tabbing guide and the key card also being printed in substantially identical colors, the tabbing guide further comprising at least one cell corresponding horizontally or vertically to each of the plurality of blocks, each cell containing reference information related to a topic corresponding to that cell;

locating the referenced information in one of the cells on the tabbing guide, corresponding to a particular related topic, pre-printed on a particular one of the plurality of pages of the bound reference book being indexed;

highlighting the referenced information pre-printed on the particular book page, using a color substantially corresponding to the color of the block of a corresponding related topic on each of the key card and the tabbing guide;

placing the consulted tabbing guide on the particular book page;

placing a flag or tab, having a color substantially corresponding to a color of the block of a corresponding related topic on each of the key card and the selected tabbing guide, on an edge of the particular book page which corresponds to the edge of the key card and to a location on the selected tabbing guide on which the block containing the relevant topic is disposed; and removing the selected tabbing guide from its position on the particular book page.

2. The method as recited in claim 1, wherein the affixing step comprises permanently placing the key card inside a front cover of the bound reference book.

3. The method as recited in claim 1, wherein the tabbing guide consulting step, the selected tabbing guide placing step, the locating step, the highlighting step, the flag or tab placing step, and the removing step are each repeated a second time to highlight a second passage of referenced information and to place a second flag or tab to denote the second passage of referenced information.

4. The method as recited in claim 3, wherein the second passage of referenced information is highlighted in a same color as the previous passage of referenced information, and the second flag or tab is of a same color as the previous flag or tab because the two referenced information passages are related to a same topic.

5. The method as recited in claim 3, wherein the second passage of referenced information is highlighted in a different color than the previous passage of referenced information, and the second flag or tab is of a different color than the previous flag or tab because the two referenced information passages are related to different topics.

6. The method as recited in claim 3, wherein the tabbing guide consulting step, the consulted tabbing guide positioning step, the locating step, the highlighting step, the flag or tab placing step, and the removing step are each repeated until all of the referenced information in each cell on the selected tabbing guide has been highlighted and flagged.

7. The method as recited in claim 1, wherein the key card comprises a plurality of said blocks disposed along each of the top, right-side, and bottom edges of the key card, the consulted tabbing guide includes blocks along one of the top, right-side, and bottom edges which correspond in topic and color to the blocks on a same one of the top, right-side, and bottom edges of the key card, and second and third tabbing guides, separate from the consulted tabbing guide, include blocks, respectively, on each of the other two edges of each guide, corresponding in topic and color to the blocks on the corresponding edges, respectively, on the key card, wherein the tabbing guide consulting step, the consulted tabbing guide positioning step, the locating step, the highlighting step, the flag or tab placing step, and the removing step are each repeated until all of the referenced information in each cell on each of the tabbing guides has been highlighted and flagged, and flags or tabs are disposed on each of top, right-side, and bottom edges of various pages of the book.

8. The method as recited in claim 1, wherein the bound reference book comprises a Holy Bible and the referenced information in each cell of the consulted tabbing guide comprises a Holy Bible verse or passage.

9. The method as recited in claim 8, wherein the topics disposed in the blocks on each of the key card and the consulted tabbing guide are related to child behavior, and are sequenced along a particular edge of each of the key card and the consulted tabbing guide in alphabetical order.

10. The method as recited in claim 7, and further comprising a step of storing the tabbing guides in the bound reference book for future reference.

11. The method as recited in claim 10, and further comprising a step of using the indexed bound reference book by consulting the key card, selecting a topic to be reviewed, noting the color of the block in which the topic appears on the key card, identifying one or more flags or tabs of a same color, and reviewing highlighted passages of a same color on pages of the bound reference book marked by the flags or tabs.

12. The method as recited in claim 1, and further comprising a step of preparing the key card by marking desired topics in printed blocks disposed on the key card.

13. The method as recited in claim 12, and further comprising a step of preparing one or more additional corresponding tabbing guides, by repeating the topics disposed on the key card, and inserting reference material to be indexed in cells corresponding to each of the topics.

14. The method as recited in claim 13, wherein the key card and tabbing guide preparing steps are performed using software and a printer.

15. A kit for indexing a bound reference book, comprising:

a separate, single-sheet key card having a top edge, opposed left and right side edges, and a bottom edge, comprising a plurality of blocks, each block comprising printed lines defining a space, the plurality of printed blocks being disposed along at least one of the top edge, the right side edge, and the bottom edge of the key card, wherein each block along a particular edge of the key card is printed in a distinctive color relative to the remaining blocks; and a separate, single-sheet tabbing guide having a top edge, opposed left and right side edges, and a bottom edge, wherein the tabbing guide comprises a plurality of blocks disposed along one of the top, right side, and bottom edges thereof, so that the plurality of blocks correspond positionally to the plurality of blocks disposed along a corresponding edge of the key card, wherein each of the blocks on the tabbing guide are printed in a same distinctive color as a corresponding block on a corresponding edge of the key card, the tabbing guide further comprising at least one printed cell corresponding horizontally or vertically to each of said plurality of blocks.

16. The kit as recited in claim 15, wherein the key card includes a plurality of printed blocks on each of the top edge, the right side edge, and the bottom edge thereof.

17. The kit as recited in claim 16, and further comprising second and third separate, single-sheet tabbing guides each having a plurality of printed blocks disposed, respectively, along each of the remaining ones of the top, right side, and bottom edges of the tabbing guides, wherein the printed blocks on each of the three tabbing guides correspond positionally and by color to the printed blocks on one of the top, right side, and bottom edges of the key card.

18. The kit as recited in claim 15, wherein the printed blocks on each of the key card and the tabbing guide do not contain pre-printed information but are fillable by a user.

19. The kit as recited in claim 15, wherein the printed blocks on each of the key card and the tabbing guide are pre-printed with predetermined topics.

* * * * *